US010527985B2

(12) United States Patent
Takagi

(10) Patent No.: US 10,527,985 B2
(45) **Date of Patent: *Jan. 7, 2020**

(54) FIXING DEVICE AND FIXING TEMPERATURE CONTROL METHOD OF FIXING DEVICE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Osamu Takagi, Chofu Tokyo (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/251,156

(22) Filed: Jan. 18, 2019

(65) Prior Publication Data

US 2019/0155198 A1 May 23, 2019

Related U.S. Application Data

(63) Continuation of application No. 14/715,823, filed on May 19, 2015, now Pat. No. 10,228,641.

(30) Foreign Application Priority Data

May 19, 2014 (JP) ..... 2014-103769

(51) Int. Cl.
*G03G 15/20* (2006.01)

(52) U.S. Cl.
CPC ..... *G03G 15/2053* (2013.01); *G03G 15/2039* (2013.01); *G03G 2215/0132* (2013.01); *G03G 2215/2038* (2013.01)

(58) Field of Classification Search
CPC ..... G03G 15/2042; G03G 15/2082
See application file for complete search history.

(56) References Cited

U.S. PATENT DOCUMENTS 5,402,220 A * 3/1995 Tanaka ..... G03G 15/2053 219/216
6,778,788 B2 8/2004 Tomita et al.
(Continued)

FOREIGN PATENT DOCUMENTS

JP 10-326059 12/1998
JP 2000-162906 6/2000
(Continued)

OTHER PUBLICATIONS

Non-Final Office Action for U.S. Appl. No. 14/715,823 dated Sep. 18, 2015.
(Continued)

*Primary Examiner* — Clayton E. LaBalle
*Assistant Examiner* — Leon W Rhodes, Jr.
(74) *Attorney, Agent, or Firm* — Amin, Turocy & Watson LLP

(57) ABSTRACT

According to one embodiment, a fixing device includes determination means for determining a size of an image forming area of a medium, heating means for including an endless rotating body, plural heat-generating members which are formed in a perpendicular direction to a transport direction and divided by a predetermined length, and are disposed so as to come into contact with an inner side of the rotating body, and a switching unit which switches individual conduction of these heat-generating members, and heats the medium, pressing means for forming a nip by performing pressing and contact at a position of the plural heat-generating members, and nipping and carrying the medium in the transport direction along with the heating means, and heating control means for controlling the switch-
(Continued)

ing unit to select and conduct heat-generating members and controlling the heating means to heat the medium.

20 Claims, 13 Drawing Sheets

(56) References Cited

U.S. PATENT DOCUMENTS

| | | | |
|---|---|---|---|
| 7,424,260 | B2 | 9/2008 | Nishiyama et al. |
| 7,512,370 | B2 | 3/2009 | Shimizu et al. |
| 8,103,183 | B2 | 1/2012 | Nemoto et al. |
| 8,213,822 | B2 | 7/2012 | Cook et al. |
| 9,002,220 | B2 | 4/2015 | Ishihara et al. |
| 9,235,166 | B2 | 1/2016 | Shimura |
| 2002/0031363 | A1 | 3/2002 | Tomita et al. |
| 2011/0129267 | A1 | 6/2011 | Arimoto et al. |
| 2012/0076521 | A1 | 3/2012 | Ishihara et al. |
| 2014/0076878 | A1 | 3/2014 | Shimura |
| 2014/0219696 | A1 | 8/2014 | Fujimoto et al. |
| 2014/0227001 | A1 | 8/2014 | Kishi et al. |
| 2016/0070216 | A1 | 3/2016 | Shimura |

FOREIGN PATENT DOCUMENTS

| | | |
|---|---|---|
| JP | 2002-229366 | 8/2002 |
| JP | 2009-122500 | 6/2009 |
| JP | 2010-204264 | 9/2010 |
| JP | 2011-027989 | 2/2011 |
| JP | 2011-033939 | 2/2011 |
| JP | 2012-037613 | 2/2012 |
| JP | 2012-073439 | 4/2012 |
| JP | 2012-252190 | 12/2012 |
| JP | 2014-041232 | 3/2014 |
| JP | 2014-059508 | 4/2014 |

OTHER PUBLICATIONS

Final Office Action for U.S. Appl. No. 14/715,823 dated Feb. 22, 2016.

Japanese Office Action for Japanese Patent Application No. 2014-103769 dated Oct. 24, 2017.

Non-Final Office Action for U.S. Appl. No. 14/715,823 dated Jan. 30, 2018.

Japanese Office Action for Japanese Patent Application No. 2014-103769 dated Mar. 27, 2018.

Final Office Action for U.S. Appl. No. 14/715,823 dated Jul. 26, 2018.

Japanese Office Action for Japanese Patent Application No. 2018-120559 dated Apr. 16, 2019.

* cited by examiner

FIXING DEVICE AND FIXING TEMPERATURE CONTROL METHOD OF FIXING DEVICE

CROSS-REFERENCE TO RELATED APPLICATIONS

This application is a Continuation of application Ser. No. 14/715,823 filed on May 19, 2015, the entire contents of which are incorporated herein by reference.

This application is based upon and claims the benefit of priority from Japanese Patent Application No. 2014-103769, filed May 19, 2014, the entire contents of which are incorporated herein by reference.

FIELD

Embodiments described herein relate generally to a fixing device and a fixing temperature control method of the fixing device.

BACKGROUND

A lamp which is representatively a halogen lamp and generates infrared rays, or a method of performing heating with Joule's heating by using electromagnetic induction is put into practical use as a heat source of a fixing device which is mounted in an image forming apparatus.

Generally, the fixing device is configured by a pair of a heating roller (or a fixation belt crossing over a plurality of rollers) and a pressing roller. However, it is required that heat capacity of components is reduced as much as possible and heating is performed focused on a heating area, in order to maximize thermal efficiency of the fixing device. In this regard, in the above-described heating method, the width of a heating area is wide and thus it is difficult to apply heat energy which is dispersed in a wide range to only a nip portion intensively and it is difficult to optimize the thermal efficiency.

In a fixing device for electrophotography, when heating unevenness occurs in a perpendicular direction to a paper transport direction, the unevenness has an influence on fixing quality. Particularly, when color printing is performed, a difference in color formation or luster may occur.

In a fixing device having extremely reduced heat capacity, the temperature at a portion through which paper does not pass is extremely increased. Thus, a problem such as speed irregularity may occur due to warpage of a heater, deterioration of a belt, and expansion of a transporting roller. In view of energy saving, heating the portion through which the paper does not pass is not preferable. In view of environmental correspondence, intensively heating only a portion through which paper passes causes an important technical problem.

An example of the related art includes JP-A-2000-243537.

DETAILED DESCRIPTION

Considering the above-described problems, an object of exemplary embodiments is to provide a fixing device and a fixing temperature control method of the fixing device which enables a paper passing area to be stably heated in a concentrated manner and in which it is possible to obtain improvement of fixing quality and energy saving.

In general, according to one embodiment, a fixing device includes determination means, heating means, pressing means, and heating control means. The determination means determines a size of an image forming area of a medium on which a toner image is formed. The heating means includes an endless rotating body, a plurality of heat-generating members, and a switching unit, and heats the medium. The plurality of heat-generating members are formed in a perpendicular direction to a transport direction of the medium and divided by a predetermined length, and are disposed so as to come into contact with an inner side of the rotating body. The switching unit switches individual conduction of these heat-generating members. The pressing means forms a nip by performing pressing and contact at a position of the plurality of heat-generating members in the heating means, and nips and carries the medium in the transport direction along with the heating means. The heating control means controls the switching unit to select and conduct heat-generating members corresponding to a position through which the image forming area of the medium passes and controls the heating means to heat the medium.

Embodiment 1

Figure 1:
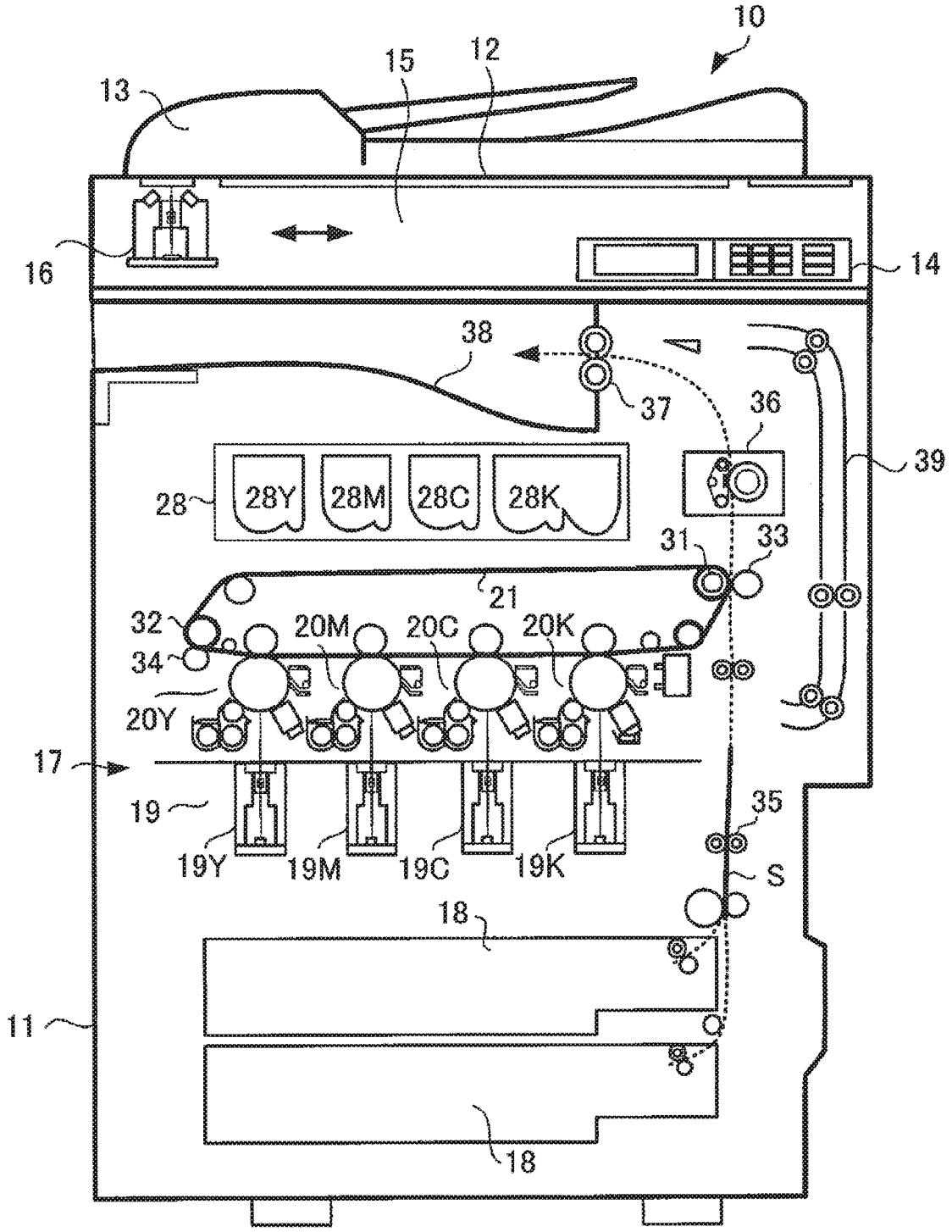
FIG. 1 is a diagram illustrating a configuration example of an image forming apparatus in which a fixing device according to Embodiment 1 is mounted.

FIG. 1 is a diagram illustrating a configuration example of an image forming apparatus in which a fixing device according to Embodiment 1 is mounted. In FIG. 1, the image forming apparatus 10 is, for example, a combined machine such as a multifunction peripheral (MFP), a printer, and a copier. In the following descriptions, an MFP is used as an example.

There is a manuscript stand 12 of transparent glass on an upper portion of a main body 11 in the MFP 10. An automatic document feeder (ADF) 13 is provided on the manuscript stand 12 to be freely opened and closed. An operation panel 14 is provided on the upper portion of the main body 11. The operation panel 14 includes various keys and a touch panel type display unit.

A scanner unit 15 which is a reading device is provided under the ADF 13 in the main body 11. The scanner unit 15 reads an original document which is fed by the ADF 13 or an original document which is placed on the manuscript stand, and generates image data. Thus, the scanner unit 15 includes a contact type image sensor 16 (simply referred to as an image sensor below). The image sensor 16 is disposed in a main scanning direction (depth direction in FIG. 1).

The image sensor 16 reads an original document image line by line while moving along the manuscript stand 12 when reading an image of an original document which is placed on the manuscript stand 12. This operation is performed over the entire size of the original document and thus reading the original document for one page is performed. When reading an image of an original document which is fed by the ADF 13, the image sensor 16 has a fixed position (illustrated position).

A printer unit 17 is included in the center portion of the main body 11. A plurality of paper cassettes 18 which are for storing various sizes of paper P are included in a lower portion of the main body 11. The printer unit 17 includes a photoconductive drum and a scanning head 19 which includes an LED as an exposing device. The printer unit 17 scans a photoconductor with light beams from the scanning head 19 and generates an image.

The printer unit 17 processes image data which is read by the scanner unit 15, or image data which is created by a personal computer or the like, and forms an image on paper. The printer unit 17 is, for example, a tandem type color laser printer and includes an image forming unit 20Y for yellow (Y), an image forming unit 20M for magenta (M), an image forming unit 20C for cyan (C), and an image forming unit 20K for black (K). The image forming units 20Y, 20M, 20C, and 20K are disposed in parallel on a lower side of an intermediate transfer belt 21 along a downstream side from an upstream side. The scanning head 19 also includes a plurality of scanning heads 19Y, 19M, 19C, and 19K respectively corresponding to the image forming units 20Y, 20M, 20C, and 20K.

Figure 2:
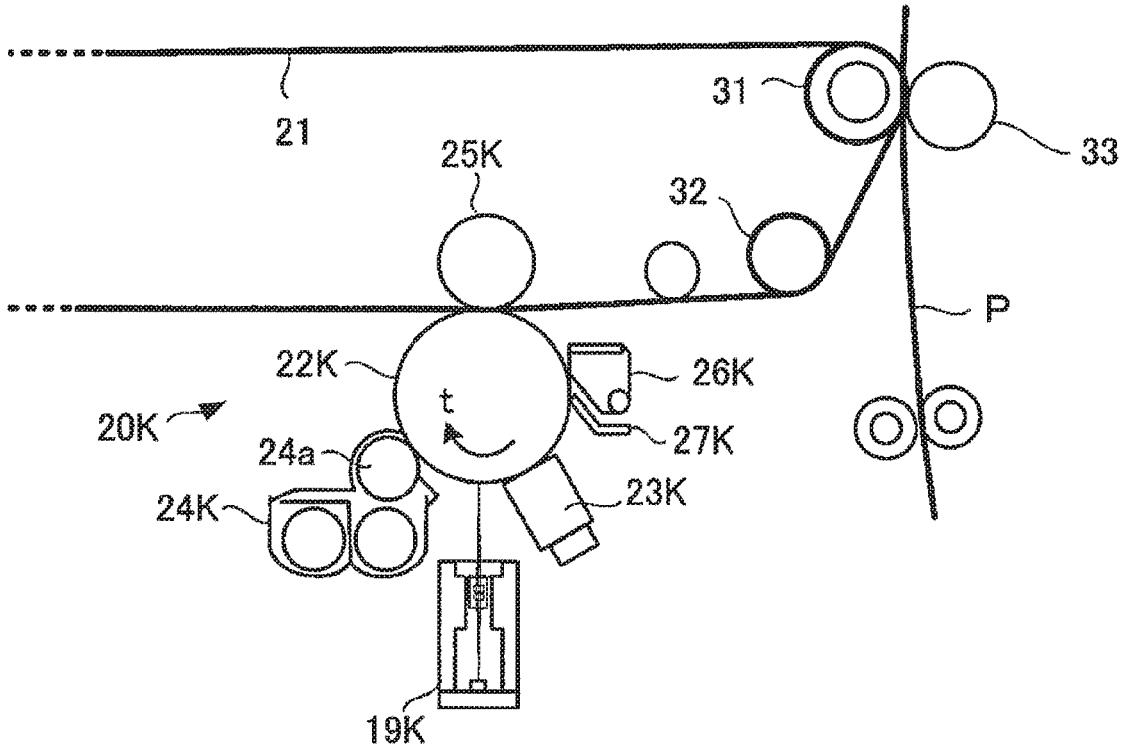
FIG. 2 is a configuration diagram illustrating a partially enlarged portion of the image forming unit according to Embodiment 1.

FIG. 2 is a configuration diagram illustrating the image forming unit 20K which is enlarged among the image forming units 20Y, 20M, 20C, and 20K. Since the image forming units 20Y, 20M, 20C, and 20K have the same configuration in the following descriptions, descriptions will be made by using the image forming unit 20K as an example.

The image forming unit 20K includes a photoconductive drum 22K which is an image carrying body. A charger 23K, a developing device 24K, a primary transfer roller (transferring device) 25K, a cleaner 26K, a blade 27K, and the like are disposed around the photoconductive drum 22K along a rotation direction t. An exposure position of the photoconductive drum 22K is irradiated with light from the scanning head 19K and thus an electrostatic latent image is formed on the photoconductive drum 22K.

The charger 23K of the image forming unit 20K causes a surface of the photoconductive drum 22K to be uniformly charged. The developing device 24K supplies a two-component developer which contains black toner and carriers to the photoconductive drum 22K by using a developing roller 24*a* to which developing bias is applied, and develops the electrostatic latent image. The cleaner 26K removes a residual toner on a surface of the photoconductive drum 22K by using the blade 27K.

As illustrated in FIG. 1, a toner cartridge 28 for supplying a toner to each of the developing devices 24Y to 24K is provided over the image forming units 20Y to 20K. The toner cartridge 28 includes toner cartridges for yellow (Y), magenta (M), cyan (C), and black (K).

The intermediate transfer belt 21 moves circularly. The intermediate transfer belt 21 crosses over a driving roller 31 and a driven roller 32. The intermediate transfer belt 21 faces and comes into contact with the photoconductive drums 22Y to 22K. A primary transfer voltage is applied to a position of the intermediate transfer belt 21 facing the photoconductive drum 22K by the primary transfer roller 25K, and a toner image on the photoconductive drum 22K is primarily transferred to the intermediate transfer belt 21.

A secondary transfer roller 33 is disposed to face the driving roller 31 over which the intermediate transfer belt 21 crosses. When the paper P passes through between the driving roller 31 and the secondary transfer roller 33, a secondary transfer voltage is applied to the paper P by the secondary transfer roller 33. Thus, the toner image on the intermediate transfer belt 21 is secondarily transferred to the paper P. A belt cleaner 34 is provided in the vicinity of the driven roller 32 of the intermediate transfer belt 21.

As illustrated in FIG. 1, a feeding roller 35 for transporting the paper P which is taken out from the paper cassette 18 is provided in the middle of a path from the paper cassette 18 to the secondary transfer roller 33. A fixing device 36 is provided downstream of the secondary transfer roller 33. A transporting roller 37 is provided downstream of the fixing device 36. The transporting roller 37 discharges the paper P to a paper discharge unit 38. A reverse transport path 39 is provided downstream of the fixing device 36. The reverse transport path 39 is for causing the paper P to be reversed and introducing the reversed paper P in a direction of the secondary transfer roller 33. Thus, the reverse transport path 39 is used when double-sided printing is performed. FIGS. 1 and 2 illustrate an example of the embodiment. A structure of the image forming apparatus part except for the fixing device is not limited thereto and a structure of a known electrophotographic type image forming apparatus may be used.

Figure 3:
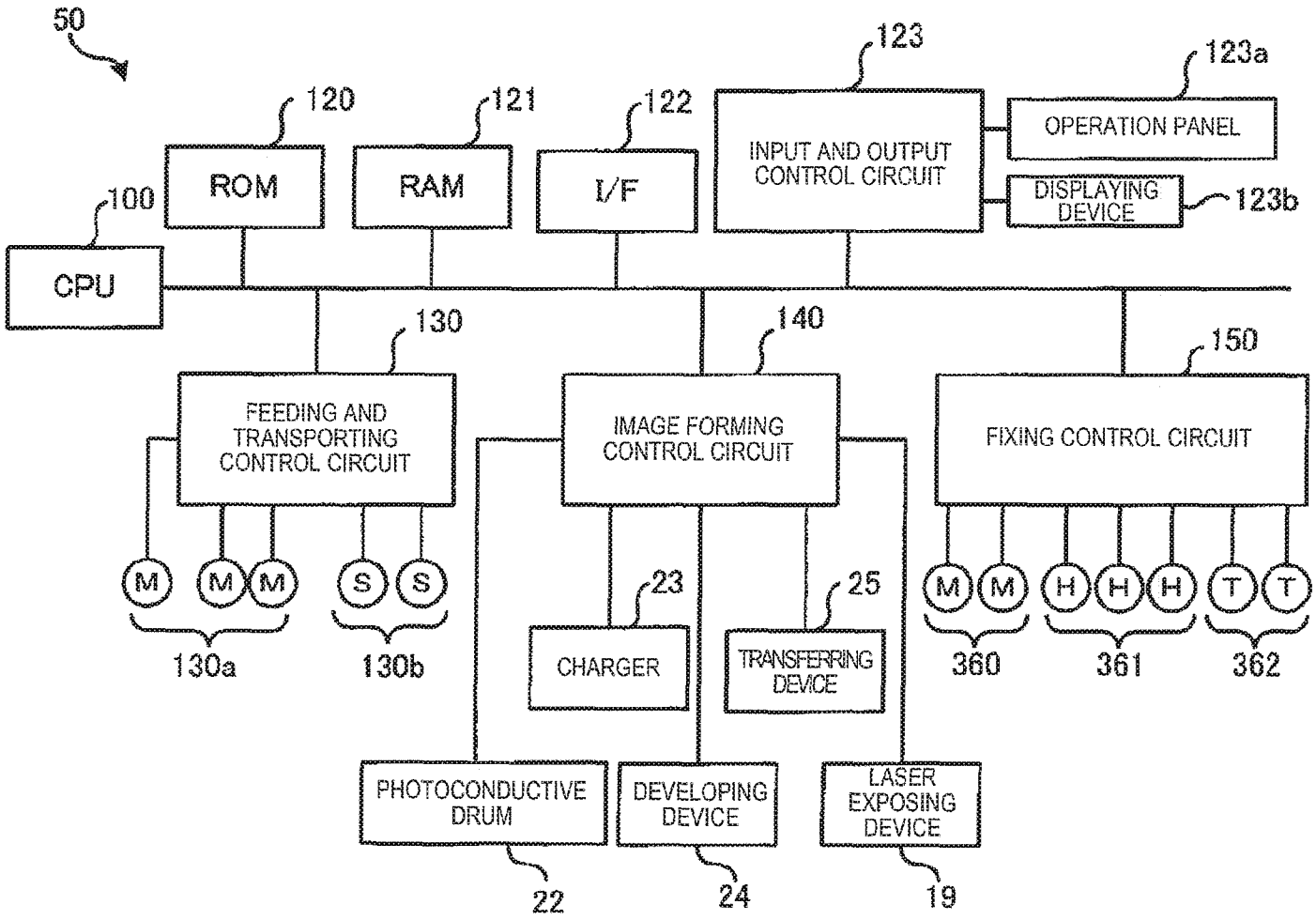
FIG. 3 is a block diagram illustrating a configuration example of a control system in an MFP according to Embodiment 1.

FIG. 3 is a block diagram illustrating a configuration example of a control system 50 of the MFP 10 according to Embodiment 1. The control system 50 includes a CPU 100 for controlling the entire MFP 10, a read only memory (ROM) 120, a random access memory (RAM) 121, an interface (I/F) 122, an input and output control circuit 123, a feeding and transporting control circuit 130, an image forming control circuit 140, and a fixing control circuit 150, for example.

The CPU 100 implements processing functions for image forming by executing a program which is stored in the ROM 120 or the RAM 121. The ROM 120 stores a control program, control data, and the like for causing basic operations in image forming processing to be performed. The RAM 121 is a working memory. The ROM 120 (or the RAM 121) stores, for example, a control program for the image forming unit 20 or the fixing device 36 and various types of control data which are used by the control program. In this embodiment, a specific example of the control data includes a correspondence relationship of the size (width in the main scanning direction) of a printing area in paper and the conducted heat-generating member, and the like.

A fixing temperature control program of the fixing device 36 includes determination logic and heating control logic. The determination logic is for determining the size of an image forming area in paper on which a toner image is formed. The heating control logic is for selecting and conducting a switching element of the heat-generating member corresponding to a position through which the image forming area passes, before paper is transported into the fixing device 36, and controlling heating in the heating section.

The I/F 122 causes a user terminal and various devices such as a facsimile to communicate with each other. The input and output control circuit 123 controls an operation panel 123*a*, and a displaying device 123*b*. The feeding and transporting control circuit 130 controls a motor group 130*a* which drives the feeding roller 35 or the transporting roller 37 on a transport path, and the like. The feeding and transporting control circuit 130 controls the motor group 130*a* and the like based on a control signal from the CPU 100 considering a sensing result of various sensors 130*b* in the vicinity of the paper cassette 18 or on the transport path. The image forming control circuit 140 controls the photoconductive drum 22, a charger 23, the laser exposing device 19, a developing device 24, and a transferring device 25 based on a control signal from the CPU 100. The fixing control circuit 150 controls a driving motor 360 of the fixing device 36, a heating member 361, a temperature sensing member 362 such as a thermistor, and the like based on a control signal from the CPU 100. In this embodiment, a control program of the fixing device 36 and control data are stored in a storage device of the MFP 10 and are executed by the CPU 100. However, a computation device and a storage device which are dedicated for the fixing device 36 may be individually provided.

Figure 4:
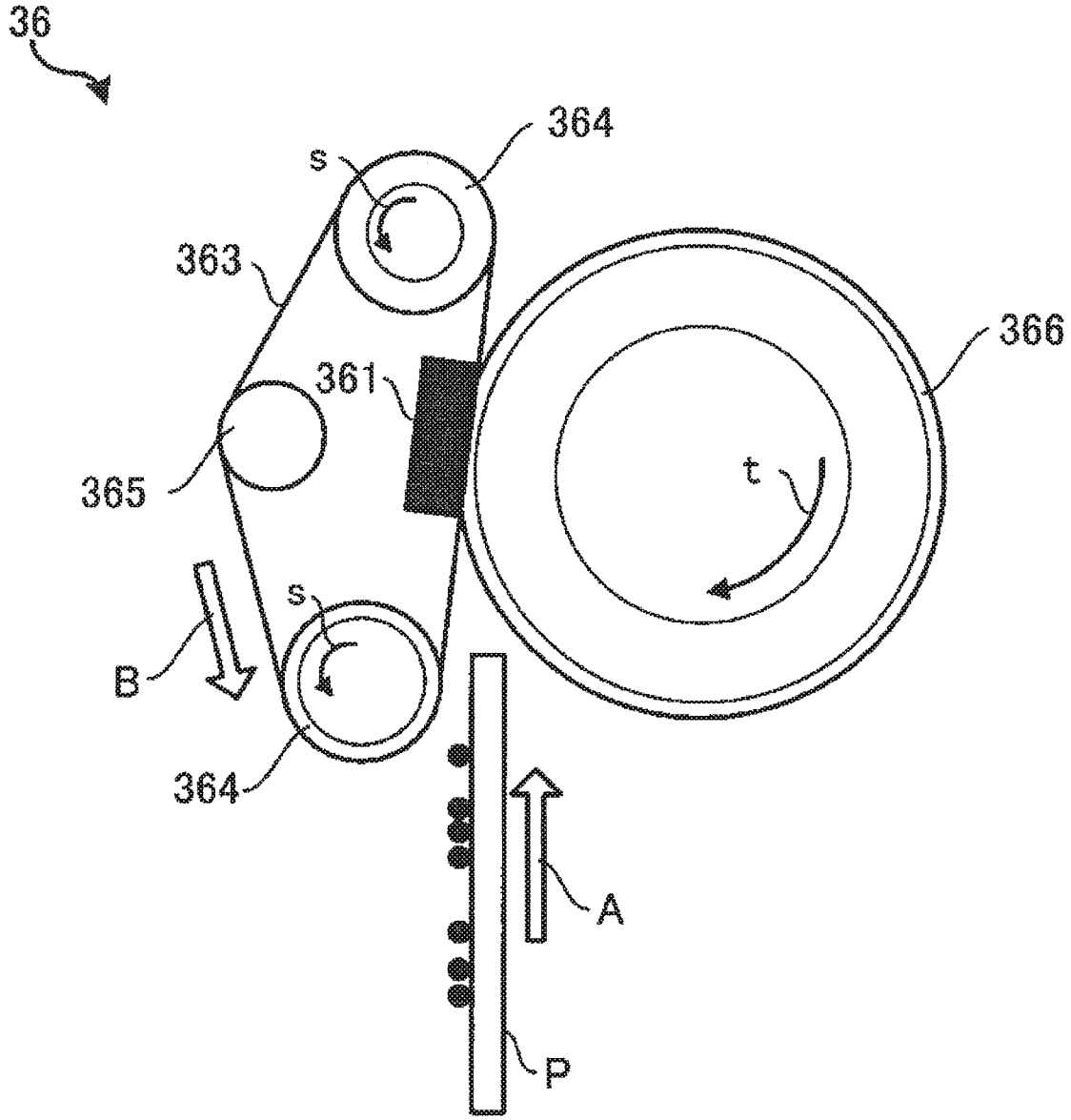
FIG. 4 is a diagram illustrating a configuration example of a fixing device according to Embodiment 1.

FIG. 4 is a diagram illustrating a configuration example of the fixing device 36. In FIG. 4, the fixing device 36 includes the plate-shaped heating member 361, an endless belt 363, a belt transporting roller 364 for driving the endless belt 363, a tension roller 365 for applying tension to the endless belt 363, and a pressing roller 366. The endless belt 363 has an elastic layer and crosses over a plurality of rollers. An elastic layer is formed on a surface of the pressing roller 366. The heat-generating unit side of the heating member 361 is brought into contact with the inner side of the endless belt 363 and is pressed in a direction of the pressing roller 366, and thus the heating member 361 forms a fixing nip having a predetermined width at a portion between the heating member 361 and the pressing roller 366. With a configuration in which the heating member 361 forms a nip area and performs heating, responsiveness when conduction is performed is higher than that when a halogen lamp performs heating.

In the endless belt 363, a silicon rubber layer with a thickness of 200 um is formed on the outer side on an SUS base member with a thickness of 50 um, or on polyimide which is a heat-resistant resin and has a thickness of 70 um, and the outermost circumference is covered with a surface protective layer which is formed of a PFA, and the like, for example. In the pressing roller 366, a silicon sponge layer with a thickness of 5 mm is formed on a surface of an iron rod having 10 mm of ϕ and the outermost circumference is covered with a surface protective layer which is formed of a PFA, and the like, for example.

In the heating member 361, a glazed layer and a heat-generating resistor layer are stacked on a ceramic substrate. In order to emit residual heat to an opposite side and to prevent warpage of the substrate, an aluminum heat sink is bonded. The heat-generating resistor layer is formed of a known material such as $TaSiO_2$, for example, and is divided by a predetermined length and predetermined numbers in the main scanning direction.

A forming method of the heat-generating resistor layer is similar to a known method (for example, creating method of thermal head). An aluminum mask layer is formed on the heat-generating resistor layer. A portion between the heat-generating members which are adjacent to each other is insulated and an aluminum layer is formed with a pattern in which heat-generating resistors (heat-generating member) are exposed in a paper transport direction. Wires are respectively linked from aluminum layers (electrodes) at both ends of the heat-generating member 361*a* to a switching element of a switching driver IC, and thus conduction of the heat-generating member 361*a* is controlled. A protective layer is formed on the top portion in order to cover all of the heat-generating resistor, the aluminum layer, the wire, and the like. The protective layer is formed of, for example, $Si_3N_4$ or the like.

Figure 5:
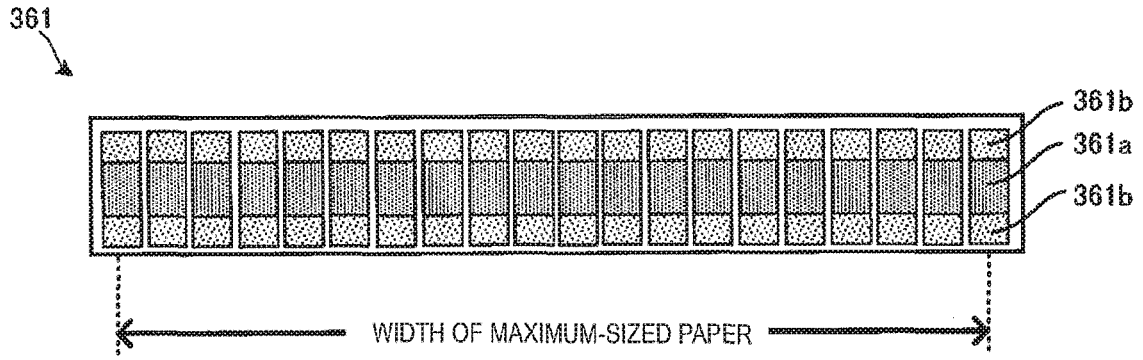
FIG. 5 is an arrangement diagram of heat-generating member groups in Embodiment 1.
Figure 6:
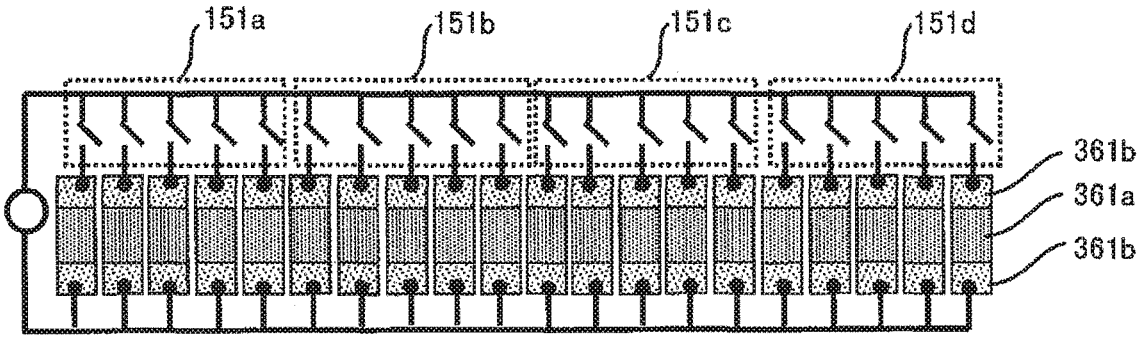
FIG. 6 is a diagram illustrating a connection state of the heat-generating member group and a driving circuit thereof in Embodiment 1.

FIG. 5 is an arrangement diagram of the heat-generating member groups in this embodiment. FIG. 6 is a diagram illustrating the heat-generating member groups and a connection state of driving circuits of the heat-generating member groups. As illustrated in FIGS. 5 and 6, a plurality of heat-generating members 361*a* having a predetermined width are disposed to be lined up on the ceramic substrate in the main scanning direction (right and left direction in FIG. 5). Electrodes 361*b* are respectively formed at both end portions of the heat-generating member 361*a* in the paper transport direction (up and down direction in FIG. 5). FIG. 6 illustrates that conduction of each of the heat-generating members 361*a* is individually controlled by corresponding driving ICs 151*a* to 151*d*. A specific example of the driving ICs 151*a* to 151*d* which are switching units of the heat-generating members 361*a* includes a switching element, an FET, a TRIAC, a switching IC, and the like.

Figure 7:
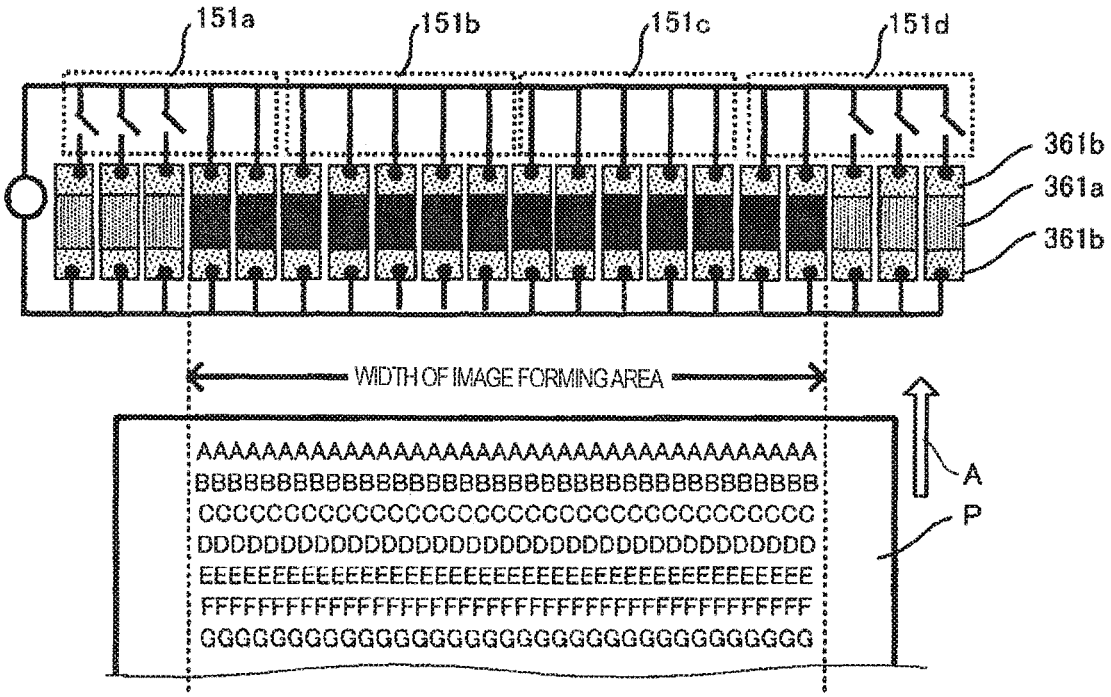
FIG. 7 is a diagram illustrating a positional relationship of the heat-generating member group and a printing area of paper in Embodiment 1.

FIG. 7 is a diagram illustrating a positional relationship of the heat-generating member groups and the printing area of paper in Embodiment 1. FIG. 7 illustrates that when paper P is transported in the paper transport direction which is indicated by an arrow A, only the heat-generating members 361*a* corresponding to a position through which the printing area (image forming area) of the paper passes are selectively conducted and heated. That is, only the printing area of the paper P is intensively heated. In this embodiment, the size of the printing area in the paper P is determined before the paper P is transported into the fixing device 36. As a method of determining the printing area in the paper P, a method of using an analysis result of image data, a method based on printing format information regarding margin setting for the paper P and the like, a method of performing determination based on a detection result of an optical sensor, and the like are included.

Figure 8A:
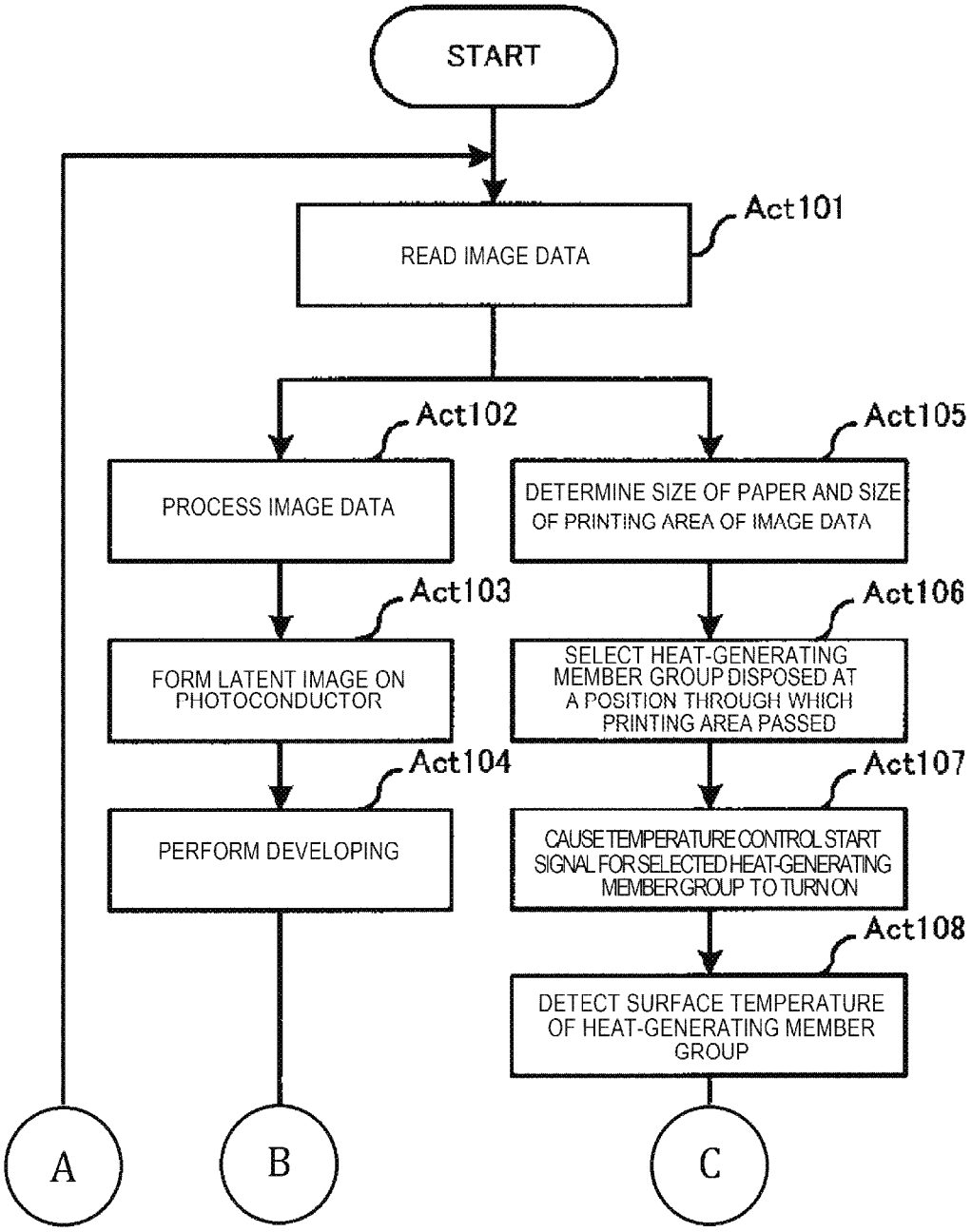
FIGS. 8A to 8C are flowcharts illustrating a specific example of a control operation of an MFP in Embodiment 1.
Figure 8B:
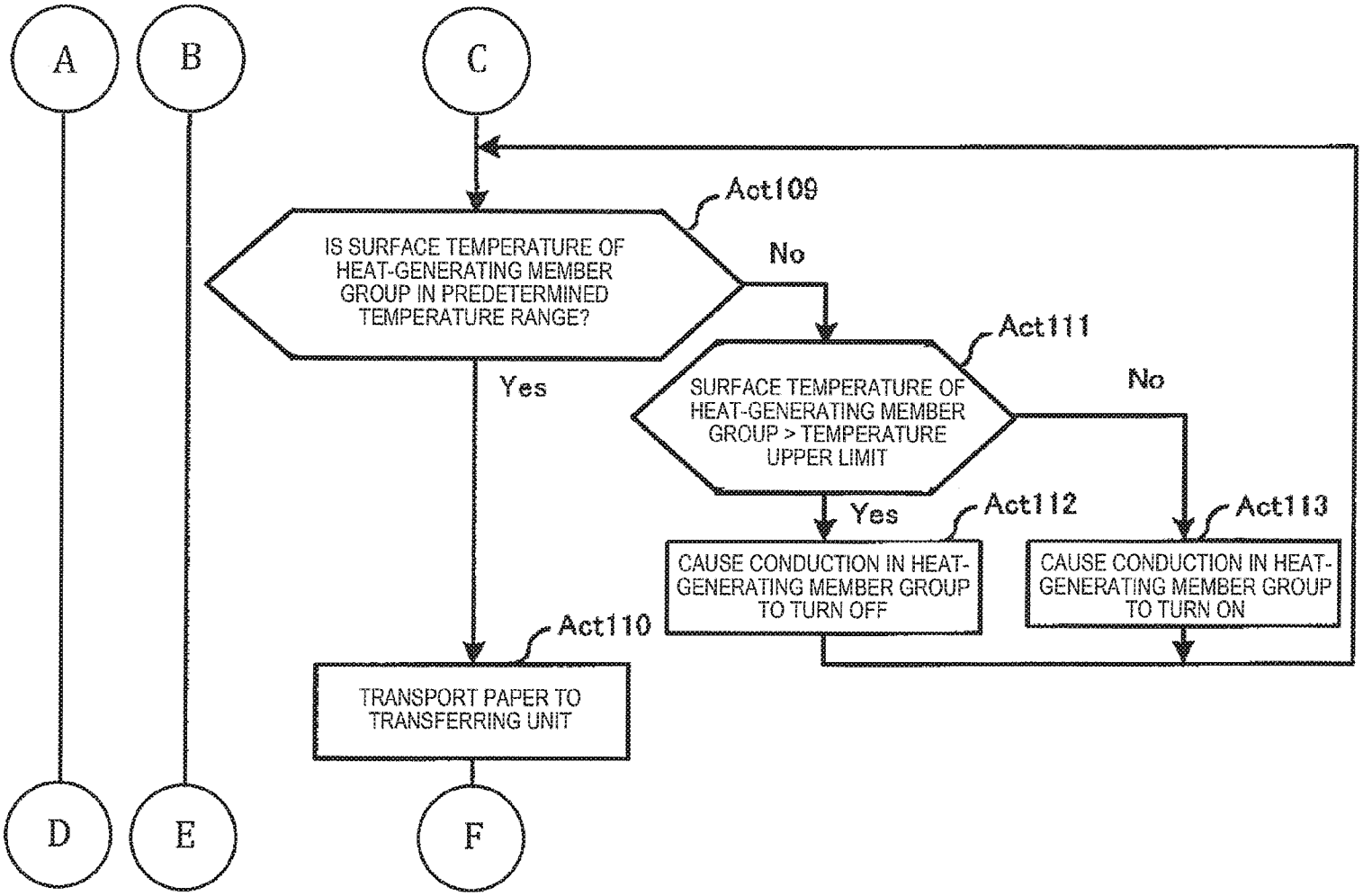
Figure 8C:
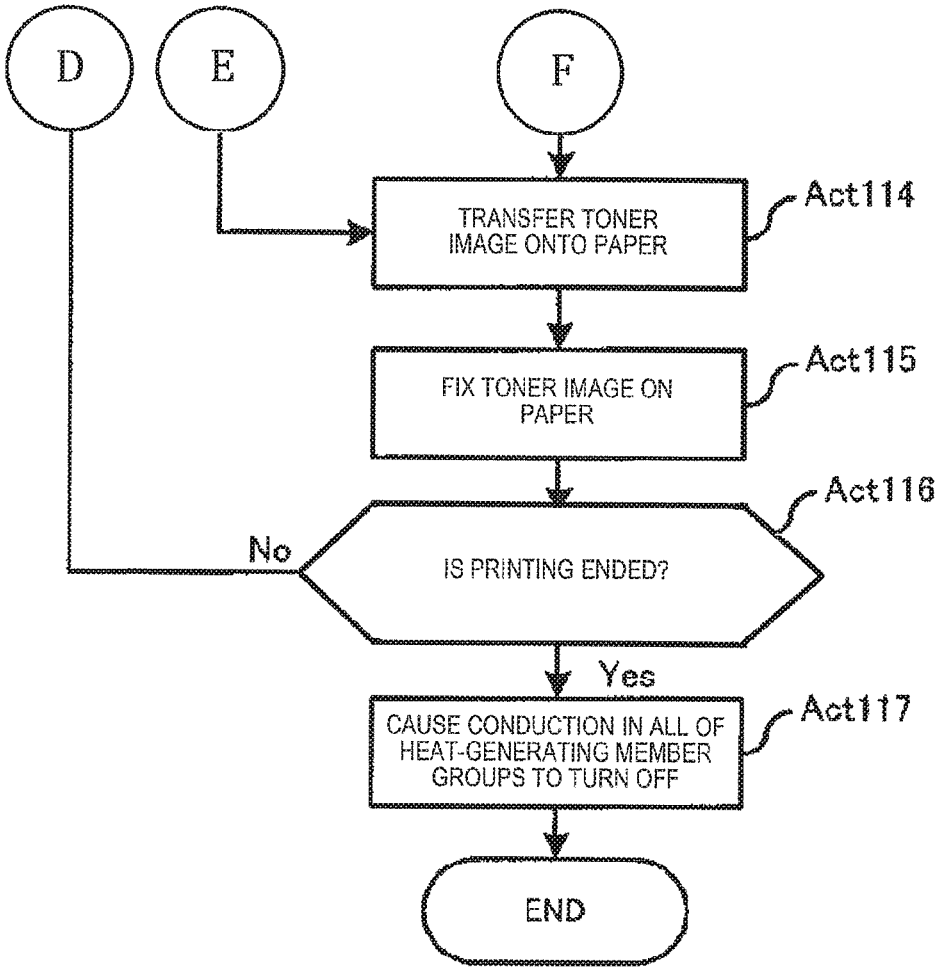

An operation of the MFP 10 having the above-described configuration when printing is performed will be described below based on the drawings. FIGS. 8A to 8C are flowcharts illustrating a specific example of control of the MFP 10 in Embodiment 1.

First, if the scanner unit 15 reads image data (Act 101), an image forming control program in the image forming unit 20 and the fixing temperature control program in the fixing device 36 are executed in parallel.

If image forming processing is started, the read image data is processed (Act 102) and an electrostatic latent image is formed on the surface of the photoconductive drum 22 (Act 103). The developing device 24 develops the electrostatic latent image (Act 104), and then the process proceeds to Act 114.

If fixing temperature control processing is started, each of a paper size and the size of a printing area of image data is determined based on, for example, a detection signal of the line sensor (not illustrated), paper selection information by the operation panel 14, an analysis result of the image data, or the like (Act 105). The heat-generating member group which is disposed at a position through which the printing area of the paper P passes is selected as a heating target (Act 106). For example, in the example illustrated in FIG. 7, 14 heat-generating members 361*a* which correspond to the width of the printing area and are disposed at the center are selected.

If a temperature control start signal for the selected heat-generating member group turns ON (Act 107), the selected heat-generating member group is conducted and the temperature of the conducted heat-generating member group is increased.

If the temperature sensing member (not illustrated) which is disposed on the inside or the outside of the endless belt 363 detects the surface temperature of the heat-generating member group (Act 108), it is determined whether or not the surface temperature of the heat-generating member group is in a predetermined temperature range (Act 109). When it is determined that the surface temperature of the heat-generating member group is in a predetermined temperature range (Yes in Act 109), the process proceeds to Act 110. On the other hand, when it is determined that the surface temperature of the heat-generating member group is not in a predetermined temperature range (No in Act 109), the process proceeds to Act 111.

In Act 111, it is determined whether or not the surface temperature of the heat-generating member group exceeds a predetermined temperature upper limit value. When it is determined that the surface temperature of the heat-generating member group exceeds a predetermined temperature upper limit value (Yes in Act 111), a conduction state of the heat-generating member group selected in Act 106 turns OFF (Act 112) and the process returns to Act 108. On the other hand, when it is determined that the surface temperature of the heat-generating member group does not exceed a predetermined temperature upper limit value (No in Act 111), it means a state where the surface temperature does not reach a predetermined temperature lower limit value by a determination result in Act 109, and thus the heat-generating member group maintains the conduction state of ON or turns ON again (Act 113). The process returns to Act 108.

If the paper P is transported to a transferring unit in a state where the surface temperature of the heat-generating member group is in the predetermined temperature range (Act 110), a toner image is transferred onto the paper P (Act 114), and then the paper P is transported into the fixing device 36.

If the toner image is fixed onto the paper P in the fixing device 36 (Act 115), it is determined whether or not printing processing of image data is ended (Act 116). When it is determined that the printing processing is ended (Yes in Act 116), the conduction state of all of the heat-generating member groups turns OFF (Act 117), and the process is ended. On the other hand, when it is determined that the printing processing of the image data is not ended (No in Act 116), that is, when image data to be printed remains, the process returns to Act 101 and similar processing is repeated until the process is ended.

In this manner, in the fixing device 36 according to this embodiment, the heating member 361 is divided into the heat-generating member group having the predetermined length in a perpendicular direction to the transport direction of the paper P and is disposed to come into contact with the inside of the endless belt 363, and the heat-generating member group corresponding to the position through which the printing area (image forming area) of image data passes is selectively conducted. A heat-generating area is switched based on the size of the printing area of the image data, and thus it is possible to prevent abnormal heat generation at a non-passing portion and to suppress useless heating at the non-passing portion. Thus, it is possible to greatly reduce thermal energy consumed by the fixing device 36. A printing portion is enabled to be stably heated in a concentrated manner and thus it is possible to improve fixation quality.

Embodiment 2

Hereinafter, a fixing device 36 according to Embodiment 2 will be described based on the drawings. In this embodiment, the configuration of the MFP 10 is similar to that in the Embodiment 1 and the same reference numerals as those in Embodiment 1 represent the same components. In the following descriptions, points different from those in Embodiment 1 will be focused and described.

Figure 9:
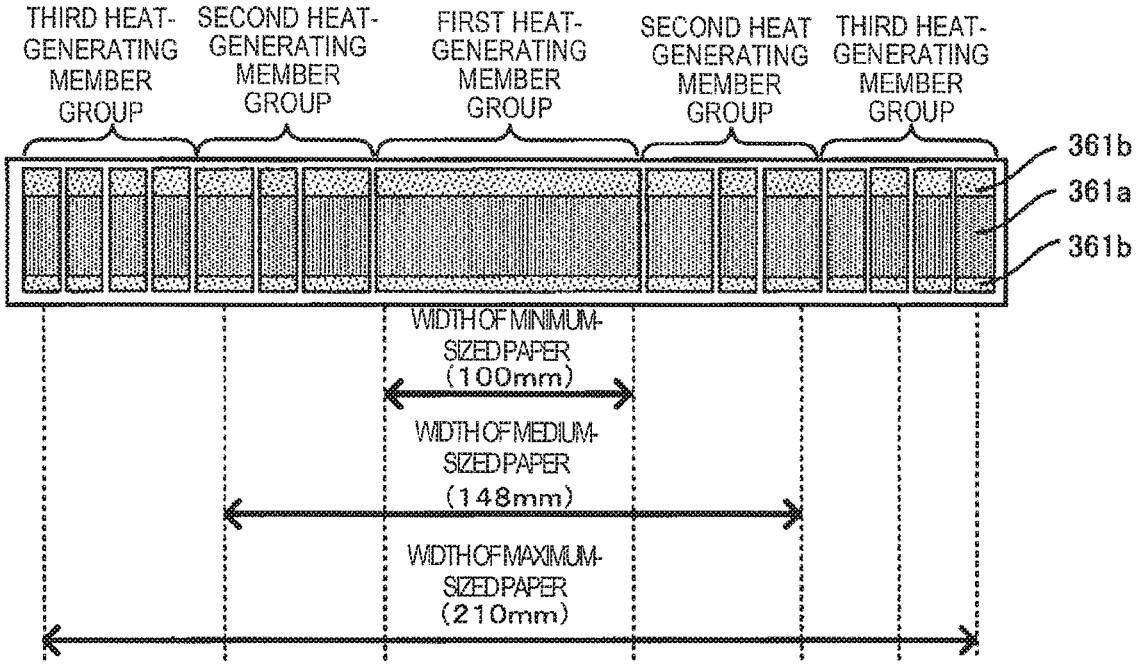
FIG. 9 is an arrangement diagram of heat-generating member groups in Embodiment 2.

FIG. 9 is an arrangement diagram of heat-generating member groups in Embodiment 2. Embodiment 2 is different from Embodiment 1 in that the heating member 361 is divided into heat-generating members (heat-generating element) 361*a* having a plurality of lengths corresponding to a postcard size (100×148 mm), a CD jacket size (121×121 mm), a B5R size (182×257 mm), and an A4R size (210×297 mm). The heat-generating member group is conducted in a heating area to which about 5% of margin is added considering transporting accuracy of transported paper, skew, and emission of heat to a non-heating portion.

For example, in order to correspond to the width of 100 mm of a postcard sized paper which is the minimum size, a first heat-generating member group is provided at the center portion in the main scanning direction (right and left direction in FIG. 9) and the width of the first heat-generating member group is set to 105 mm. In order to correspond to the second largest sizes of 121 mm and 148 mm, a second heat-generating member group having a width of 50 mm is provided on the outside of the first heat-generating member group (right and left direction in FIG. 9). The second heat-generating member group handles paper having a width up to 155 mm which is 148 mm+5%. In order to correspond to further large size of 182 mm and 210 mm, a third heat-generating member group is provided on the further outside of the second heat-generating member group, and each of heat-generating members in the third heat-generating member group has a width of 65 mm. The third heat-generating member group handles paper having a width up to 220 mm which is 210 mm+5%. The number of division of the heat-generating member group and the width of the divided heat-generating member group are only an example, and it is not limited thereto. For example, when the MFP 10 handles five medium sizes, the heat-generating member group may be divided into five groups in accordance with the respective medium sizes.

In this embodiment, a line sensor (not illustrated) is disposed in a paper passing area and thus the size and the position of paper which passes through the paper passing area are enabled to be determined in real time. When a print operation is started, a paper size may be determined by using image data or information of the paper cassette 18 which stores paper in the MFP 10.

Figure 10:
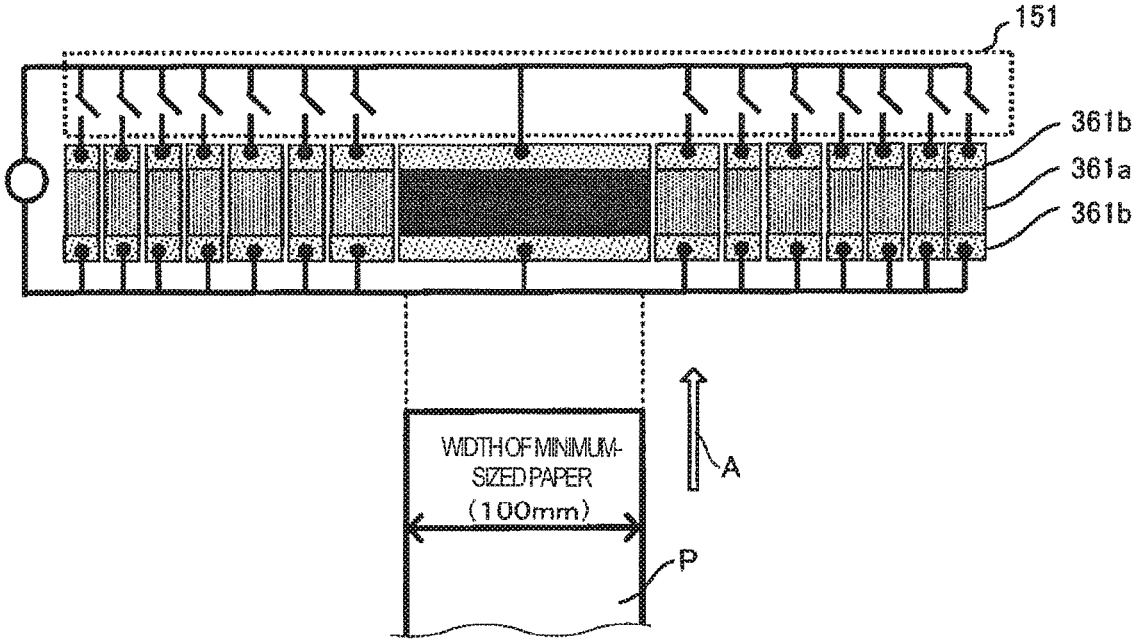
FIG. 10 is a diagram illustrating a connection state of the heat-generating member group and a driving circuit thereof when a paper size is the smallest in Embodiment 2.

FIG. 10 is a diagram illustrating a connection state of the heat-generating member groups and driving circuits thereof when a paper size is the minimum. FIG. 10 illustrates that when the paper P has the minimum size (postcard size), only a switching element of the first heat-generating member group which is disposed at the center turns ON and the first heat-generating member group is heated. As the size of the paper P is increased, the switching elements of the second heat-generating member group and the third heat-generating member group are controlled to sequentially turn ON.

Figure 11A:
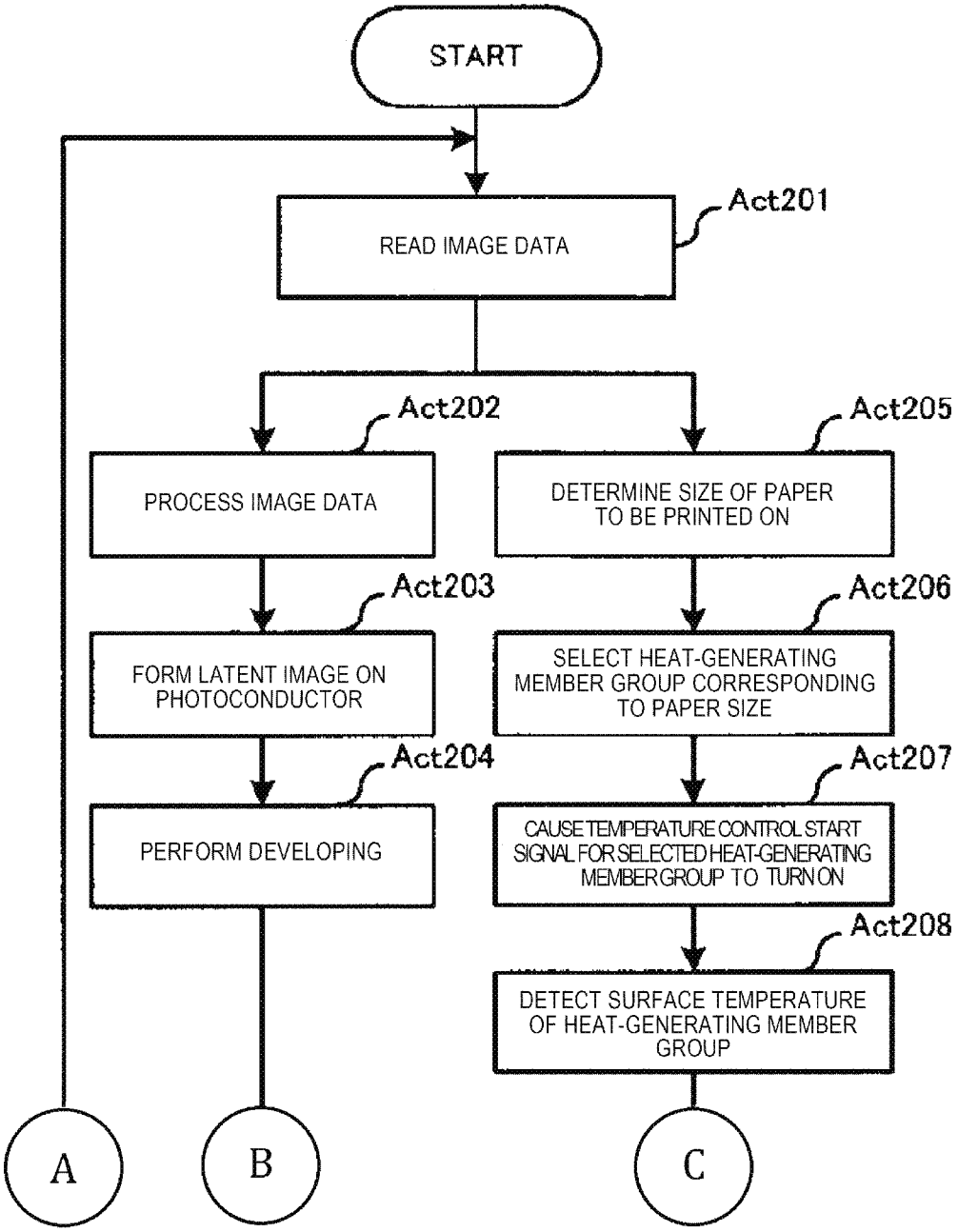
FIGS. 11A to 11C are flowchart illustrating a specific example of a control operation of an MFP in Embodiment 2.
Figure 11B:
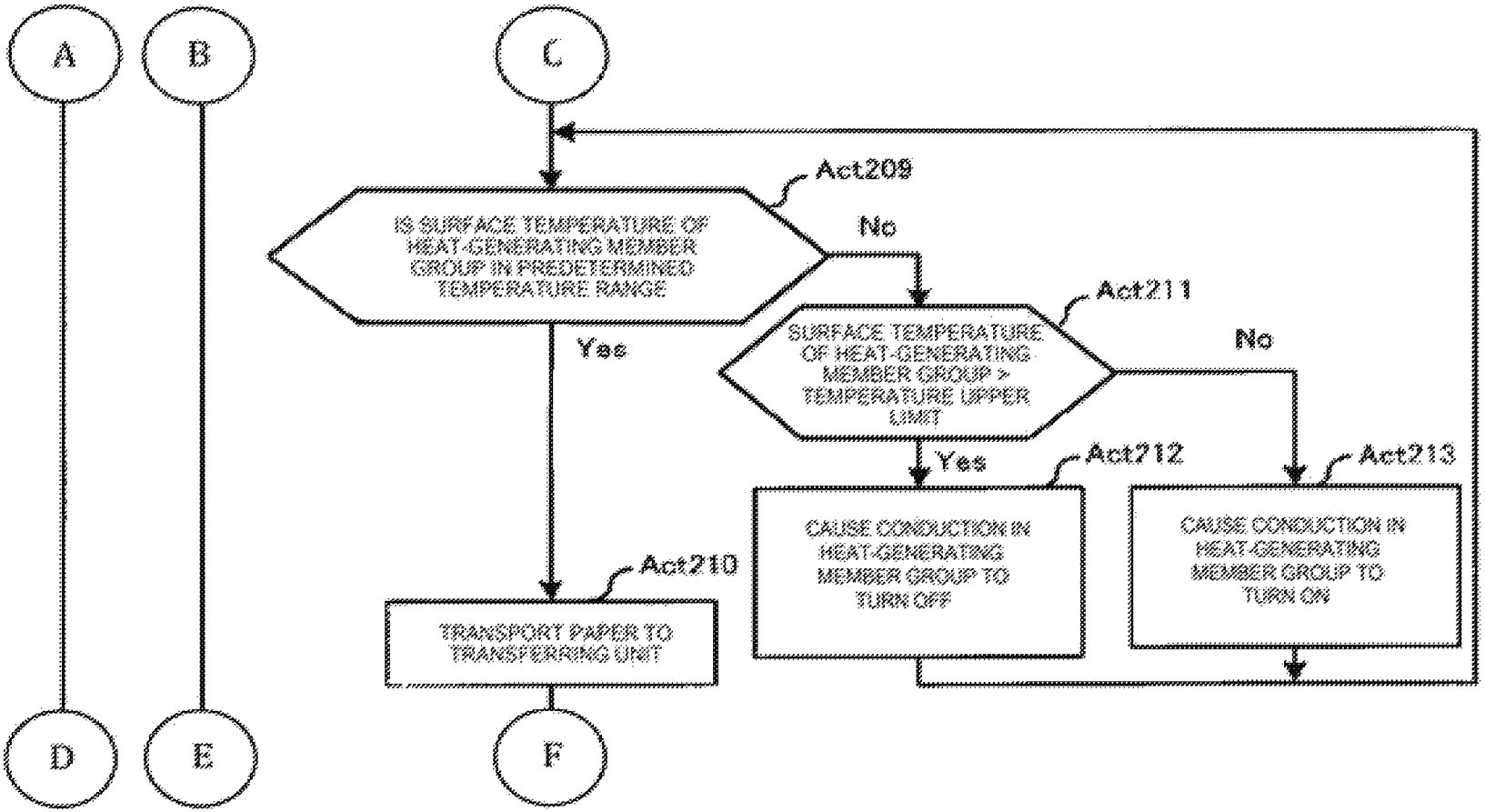
Figure 11C:
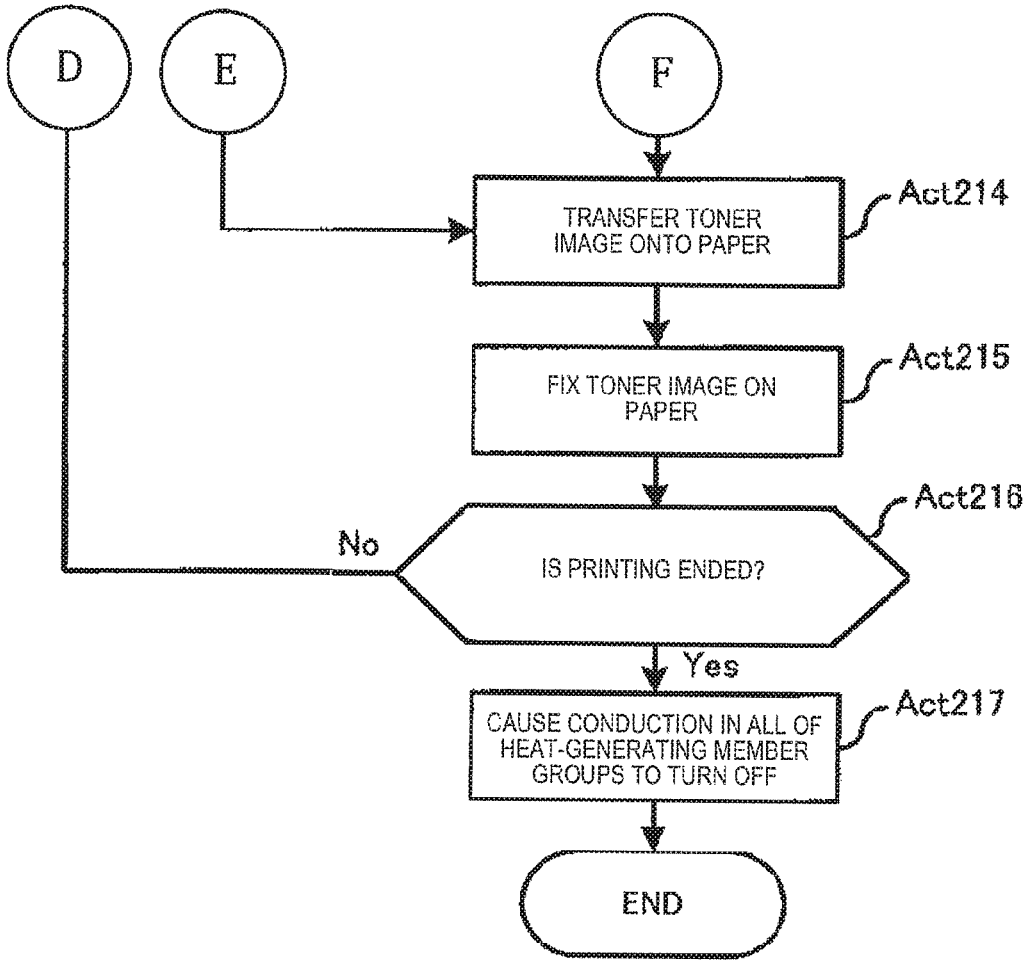

Hereinafter, an operation of the MFP 10 according to this embodiment when printing is performed will be described based on the drawings. FIGS. 11A to 11C are flowcharts illustrating a specific example of control of the MFP 10 in Embodiment 2.

First, if the scanner unit 15 reads image data (Act 201), the image forming control program in the image forming unit 20 and the fixing temperature control program in the fixing device 36 are executed in parallel.

If the image forming processing is started, the read image data is processed (Act 202) and an electrostatic latent image is formed on the surface of the photoconductive drum 22 (Act 203). The developing device 24 develops the electrostatic latent image (Act 204), and then the process proceeds to Act 214.

If the fixing temperature control processing is started, a paper size is determined based on, for example, a detection signal of the line sensor (not illustrated) and paper selection information by the operation panel 14 (Act 205). The heat-generating member group which is disposed at a position through which the paper P passes is selected as a heating target (Act 206).

If the temperature control start signal for the selected heat-generating member group turns ON (Act 207), the selected heat-generating member group is conducted and the surface temperature of the conducted heat-generating member group is increased.

If the temperature sensing member (not illustrated) which is disposed on the inside or the outside of the endless belt 363 detects the surface temperature of the heat-generating member group (Act 208), it is determined whether or not the surface temperature of the heat-generating member group is in a predetermined temperature range (Act 209). When it is determined that the surface temperature of the heat-generating member group is in a predetermined temperature range (Yes in Act 209), the process proceeds to Act 210. On the other hand, when it is determined that the surface temperature of the heat-generating member group is not in a predetermined temperature range (No in Act 209), the process proceeds to Act 211.

In Act 211, it is determined whether or not the surface temperature of the heat-generating member group exceeds a predetermined temperature upper limit value. When it is determined that the surface temperature of the heat-generating member group exceeds a predetermined temperature upper limit value (Yes in Act 211), a conduction state of the heat-generating member group selected in Act 206 turns OFF (Act 212) and the process returns to Act 208. On the other hand, when it is determined that the surface temperature of the heat-generating member group does not exceed a predetermined temperature upper limit value (No in Act 211), it means a state where the surface temperature does not reach a predetermined temperature lower limit value by a determination result in Act 209, and thus the heat-generating member group maintains the conduction state of ON or turns ON again (Act 213). The process returns to Act 208.

If the paper P is transported to the transferring unit in a state where the surface temperature of the heat-generating member group is in the predetermined temperature range (Act 210), a toner image is transferred onto the paper P (Act 214), and then the paper P is transported into the fixing device 36.

If the toner image is fixed onto the paper P in the fixing device 36 (Act 215), it is determined whether or not printing processing of image data is ended (Act 216). When it is determined that the printing processing is ended (Yes in Act 216), the conduction state of all of the heat-generating member groups turns OFF (Act 217), and the process is ended. On the other hand, when it is determined that the printing processing of the image data is not ended yet (No in Act 216), that is, when image data to be printed remains, the process returns to Act 201 and similar processing is repeated until the process is ended.

In this manner, in the fixing device 36 according to this embodiment, the size of the paper P is classified into a plurality of groups, and the switching elements of the heat-generating members belonging to the heat-generating member group which is pre-correlated with each group are selected and thus the heat-generating members are conducted at the same time.

The heat-generating member group which is a heating target is switched based on the group corresponding to a paper size to be used, and thus it is possible to prevent abnormal heat generation at a non-passing portion and to suppress useless heating at the non-passing portion. Similarly to Embodiment 1, it is possible to greatly reduce thermal energy consumed by the fixing device 36. Since switching of a heating target is performed in a unit of the heat-generating member group instead of each heat-generating member, there is an advantage that the determination logic in the control program is simplified and is enabled to be easily mounted compared to Embodiment 1 in which determination is performed based on the printing area of the image data.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the configurations of Embodiment 1 and Embodiment 2 may be combined. That is, a heat-generating member group may be selected based on the magnitude of a printing size (image forming area) which is the same as in Embodiment 1 instead of the paper size in Embodiment 2.

What is claimed is:

1. A fixing device comprising:

a determiner configured to determine a size of a medium on which a toner image is formed;

an endless rotating body comprising a plurality of heat-generating members positioned in an orthogonal direction to a transport direction of the medium, the plurality of heat-generating members separated by a predetermined length and segmented into a plurality of groups; and a heat controller configured to control a plurality of driver integrated circuits each associated with one of the plurality of groups, each of the plurality of driver integrated circuits including a switching element connected to one of the plurality of heat-generating members, and to control independent selection one or more of the switching elements to continuously conduct one or more of the plurality of heat-generating members corresponding to a position through which the medium passes to heat the medium.

2. The fixing device according to claim 1, wherein the heat controller controls the one or more of the plurality of switching elements at the same time.

3. The fixing device according to claim 1, wherein the plurality of groups include a center group, and one of the plurality of heat-generating members having a width larger than the size of the smallest medium is segmented into the center group.

4. The fixing device according to claim 3, wherein the plurality of groups include a plurality of side groups arranged at both sides of the center group, and a total width of conducted one or more of the plurality of heat-generating members which belong to the center group or to the center group and the side groups is larger than the determined size of the medium.

5. The fixing device according to claim 1, wherein the determiner determines the size of the image forming area of the medium based on an analysis result of image data or printing format information which is predefined to correspond to the medium.

6. The fixing device according to claim 1, further comprising:

a classifier configured to classify the size of the medium by another plurality of groups, and the heat controller controls the switching element to select the heat-generating members which belong to a heat-generating member group in association with the classification in advance and to conduct the selected heat-generating members at the same time.

7. An image forming apparatus, comprising:

a printing unit to form a toner image on a medium; and a fixing device comprising:

a determiner configured to determine a size of the medium on which the toner image is formed;

an endless rotating body comprising a plurality of heat-generating members positioned in an orthogonal direction to a transport direction of the medium, the plurality of heat-generating members separated by a predetermined length and segmented into a plurality of groups; and a heat controller configured to control a plurality of driver integrated circuits each associated with one of the plurality of groups, each of the plurality of driver integrated circuits including a switching element connected to one of the plurality of heat-generating members, and to control independent selection one or more of the switching elements to continuously conduct one or more of the plurality of heat-generating members corresponding to a position through which the medium passes to heat the medium.

8. The image forming apparatus according to claim 7, wherein the heat controller controls the one or more of the plurality of switching elements at the same time.

9. The image forming apparatus according to claim 7, wherein the plurality of groups include a center group, and one of the plurality of heat-generating members having a width larger than the size of the smallest medium is segmented into the center group.

10. The image forming apparatus according to claim 9, wherein the plurality of groups include a plurality of side groups arranged at the both sides of the center group, and a total width of conducted one or more of the plurality of heat-generating members which belong to the center group or to the center group and the side groups is larger than the determined size of the medium.

11. The image forming apparatus according to claim 7, wherein the determiner determines the size of the image forming area of the medium based on an analysis result of image data or printing format information which is predefined to correspond to the medium.

12. The image forming apparatus according to claim 7, further comprising:

a classifier configured to classify the size of the medium by another plurality of groups, and the heat controller controls the switching element to select the heat-generating members which belong to a heat-generating member group in association with the classification in advance and to conduct the selected heat-generating members at the same time.

13. The image forming apparatus according to claim 7, wherein the image forming apparatus is a multifunction peripheral.

14. The image forming apparatus according to claim 6, wherein the image forming apparatus is a printer.

15. A temperature control method of a fixing device, comprising:

determining a size of a medium on which a toner image is formed;

moving an endless rotating body comprising a plurality of heat-generating members positioned in an orthogonal direction to a transport direction of the medium, the plurality of heat-generating members separated by a predetermined length and segmented into a plurality of groups;

controlling a plurality of driver integrated circuits each associated with one of the plurality of groups, each of the plurality of driver integrated circuits including a switching element connected to one of the plurality of heat-generating members; and controlling independent selection one or more of the switching elements to continuously conduct one or more of the plurality of heat-generating members corresponding to a position through which the medium passes to heat the medium.

16. The temperature control method according to claim 15, further comprising:

controlling the one or more of the plurality of switching elements at the same time.

17. The temperature control method according to claim 15, wherein the plurality of groups include a center group, and one of the plurality of heat-generating members having a width larger than the size of the smallest medium is segmented into the center group.

18. The temperature control method according to claim 17, wherein the plurality of groups include a plurality of side groups arranged at the both sides of the center group, and a total width of conducted one or more of the plurality of heat-generating members which belong to the center group or to the center group and the side groups is larger than the determined size of the medium.

19. The temperature control method according to claim 15, further comprising:

determining the size of the image forming area of the medium based on an analysis result of image data or printing format information which is predefined to correspond to the medium.

20. The temperature control method according to claim 15, further comprising:

classifying the size of the medium by another plurality of groups, and selecting the heat-generating members which belong to a heat-generating member group in association with the classification in advance and to conduct the selected heat-generating members at the same time.

* * * * *